United States Patent [19]

Eudy et al.

[11] 3,952,683

[45] Apr. 27, 1976

[54] ANCHOR DAVIT

[76] Inventors: Charles Nelson Eudy, P.O. Box 129, Houston, Miss. 38851; Charles Ellis Eudy, 219 S. Park Drive, Jackson, Miss. 39211

[22] Filed: Apr. 28, 1975

[21] Appl. No.: 572,208

Related U.S. Application Data

[63] Continuation-in-part of Ser. No. 430,098, Jan. 2, 1974, abandoned.

[52] U.S. Cl. ..... 114/210

[51] Int. Cl.[2] ..... B63B 21/22

[58] Field of Search ..... 114/206, 210; 254/197

[56] References Cited

UNITED STATES PATENTS

| | | | |
|---|---|---|---|
| 292,476 | 1/1884 | Ferris | 254/197 |
| 1,022,569 | 4/1912 | Trewhella | 254/210 |
| 1,644,164 | 10/1927 | Adams | 254/197 |
| 2,831,450 | 4/1958 | Schiele | 114/210 |
| 3,071,097 | 1/1963 | Dowrelio | 114/210 |

*Primary Examiner*—Trygve M. Blix
*Assistant Examiner*—Gregory W. O'Connor

[57] ABSTRACT

An anchor davit to facilitate handling an anchor cable and to stow the anchor in a safe, secure position when it is raised out of the water. The davit provides a cable centering, direction changing roller, rotatably supported on a mounting bracket to guide the cable over the side of a boat and to cradle and cushion the raised anchor. A retaining loop, pivotally supported on the bracket, is coaxial with the roller and cooperates therewith to hold the cable on the roller and brings about a suitable stowing position of the anchor.

10 Claims, 8 Drawing Figures

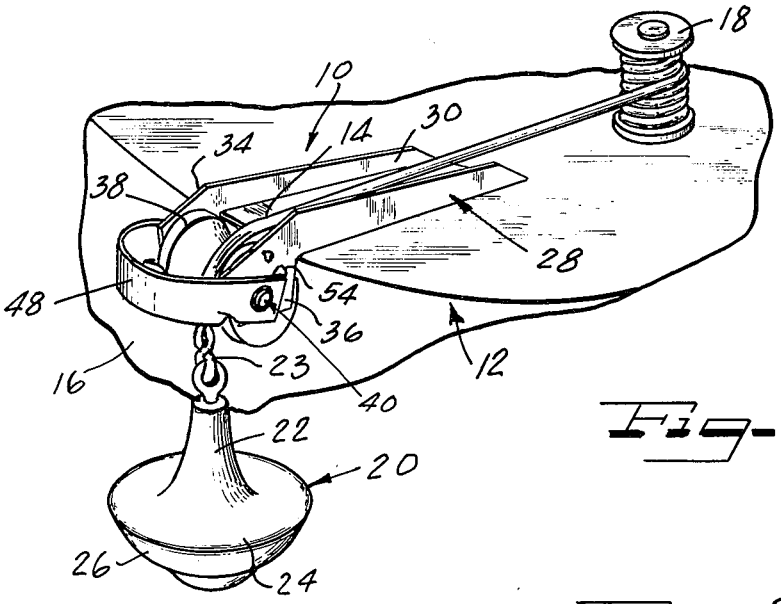
Fig-1
Fig-2
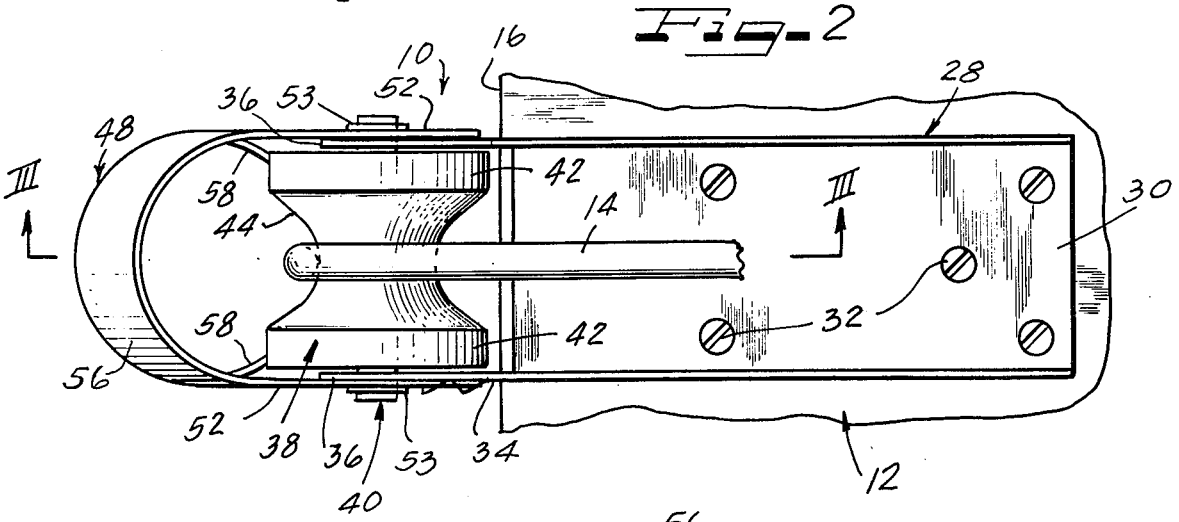
Fig-5
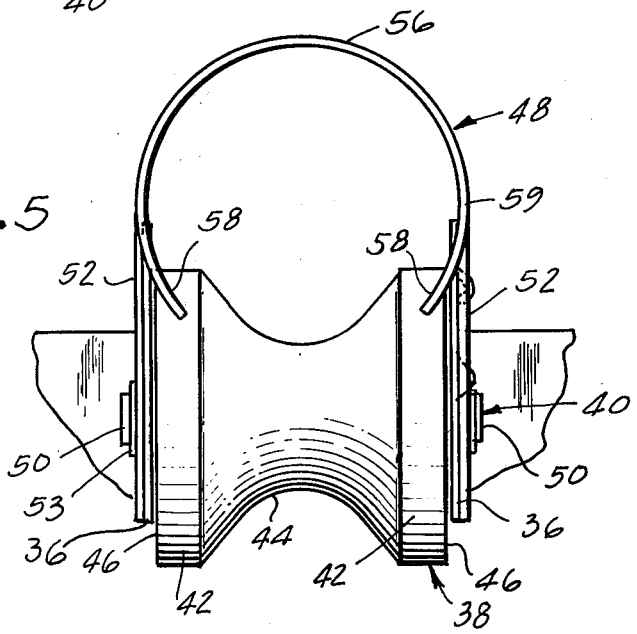

Fig. 6
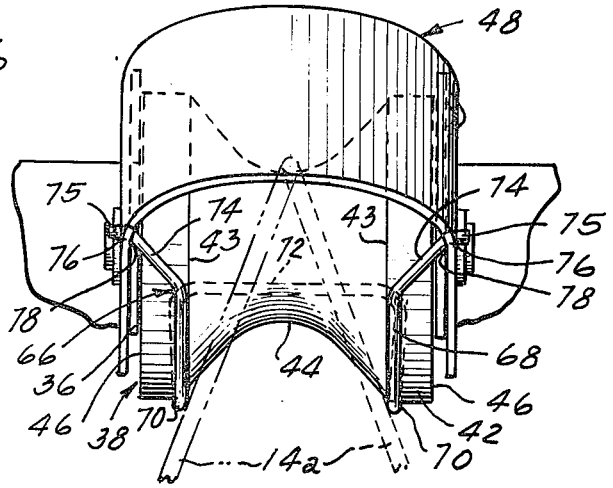
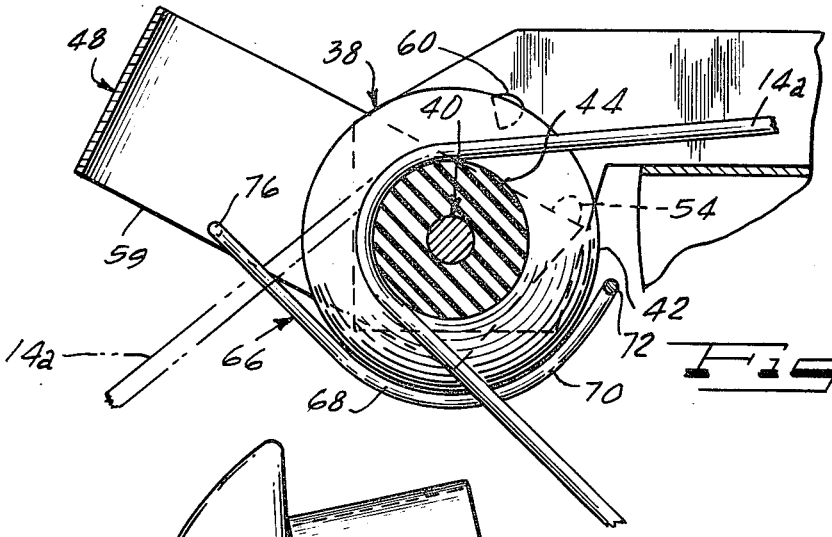
Fig. 7
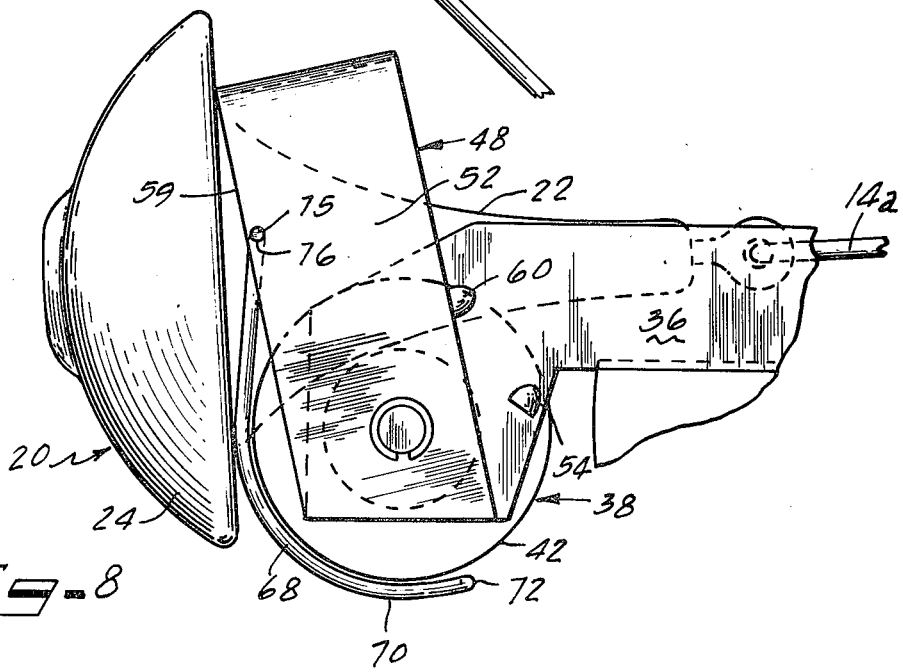
Fig. 8

ANCHOR DAVIT

RELATED APPLICATION

This application is a continuation-in-part of application Ser. No. 430,098, filed Jan. 2, 1974, which is abandoned with the filing of this application.

BACKGROUND OF THE INVENTION

1. Field of the Invention

This invention relates to an anchor davit for small fishing boats such as are suitable for bass fishing.

2. The Prior Art

With the operation of small boats, handling the anchor and anchor line has entailed some problems. Typically, as for example in bass fishing, a boat anchor when raised is stowed in a position which enables it to drop quickly into the water when released by the anchor reel for "immediate anchor control". This "quick drop" position usually locates the anchor in a generally vertical position, suspended at the side of a boat from an anchor davit which guides the anchor line to the reel. These davits allow the anchors to swing, especially in choppy waters, with damage frequently inflicted on the boat hull by the heavy swinging anchor.

More recently mushroom-type anchors have come into wide use. These anchors include a massive head portion with a shank or stem protection to which the anchor line is attached. They are constructed mostly of solid lead with a soft plastic vinyl coating as a protection for the boat hulls. Davits used with this type of anchor often provide means to resist anchor swing, provided the anchor is properly "stowed". Herein, the anchor is reeled up tightly against a rigid metal protrusion of the davit structure to minimize anchor swing while still providing immediate anchor control. Because the anchor is stowed at the boat's side and is somewhat obscured from view, it becomes rather difficult to see when the anchor is properly stowed. Further, fixed unyielding davit edges which the anchor is stowed against can cut and damage the anchor's plastic coating.

A further development in past davit designs provided a davit which stowed the anchor in a more visible, generally horizontal position above the boat's side. Herein, the anchor shank is pulled up over the anchor line guide roller and into a fixed, metal, retaining loop and against a pair of protruding ears for stowing. This design, however, holds only one size anchor shank tightly enough to prevent bouncing when negotiating rough waters. Further, anchors frequently become trapped or caught in these davits, necessitating the unsafe practice of standing and moving about the boat to free the anchor by pushing it out of the davit by hand.

SUMMARY OF THE INVENTION

With the anchor davit of the present invention, an anchor line is guided and supported on a roller rotatably mounted on the davit frame while handling an anchor in the water. A retaining loop, mounted for pivotal movement about the roller, retains the anchor line on the roller. The loop is supported in a generally horizontal position to effectively retain the anchor line on the roller. When raising the anchor out of the water for stowing, the retaining loop, upon making contact with the rising anchor, is pivoted from the anchor line retaining position to an anchor stowing position in which the anchor is brought into a clearly visible, generally horizontal position, secured against the retaining loop at the top and the roller at the bottom. The roller, which is preferably made of rubber or soft plastic, cushions the anchor to prevent damage to the anchor's plastic coating and also permits the use of anchors with different shank diameters and lengths.

A pair of tabs formed on the retaining loop or alternately a heavy wire bail mounted on the retaining loop are arranged to extend over the roller's edges to prevent the anchor line from wedging between the roller ends and the davit frame.

Accordingly, it is a principal object of this invention to provide an anchor davit which facilitates handling an anchor line and stows an anchor in a visible, safe, secure position which does not damage the anchor's plastic coating.

Another object of this invention is to provide an anchor davit which will stow the anchor in a visible, secure position and which accommodates positive, immediate control to drop the anchor when desired.

Still another object of this invention is to provide an anchor davit with a roller to center and support the anchor line, having a retaining loop arranged to prevent wedging of the line between the roller sides and the davit frame.

These and other objects and advantages will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE DRAWINGS

FIG. 1 is a fragmentary perspective view showing an anchor davit constructed in accordance with the principles of this invention, mounted to a boat hull for handling an anchor line and anchor;

FIG. 2 is a plan view of the davit of FIG. 1 showing the retaining loop in position to retain the anchor line;

FIG. 5 is an end view of the davit with the retaining loop shown in the anchor stowing position;

FIG. 6 is a view similar to FIG. 5 showing a further embodiment of a means to prevent wedging of the anchor line;

FIG. 7 is a sectional view taken along the line VI-VI in FIG. 6; and

FIG. 8 is a side elevational view of the davit shown in FIG. 6.

DESCRIPTION OF THE PREFERRED EMBODIMENT

Figure 3:
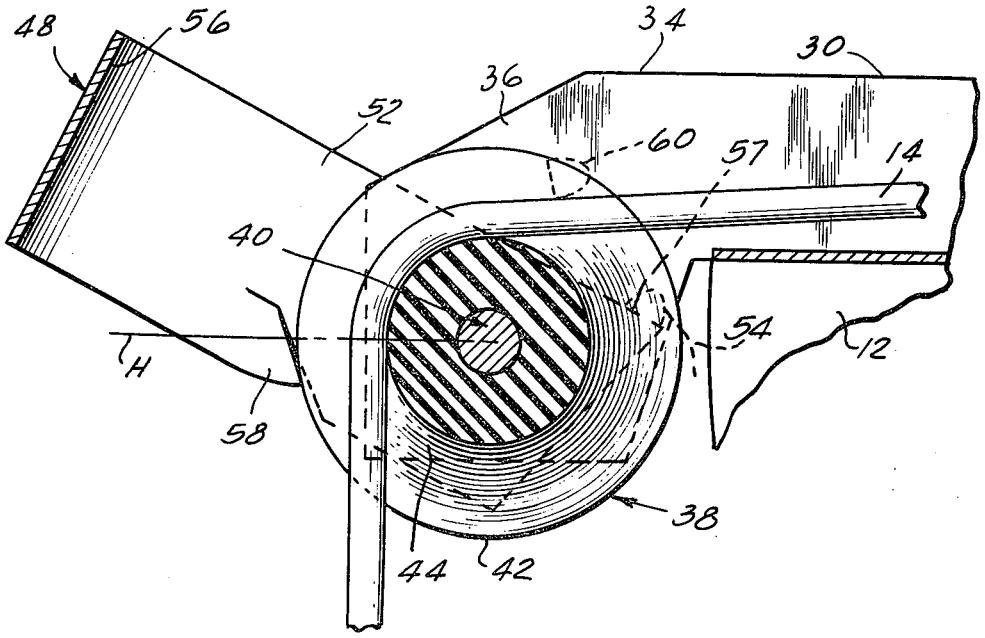
FIG. 3 is a fragmentary sectional view taken along the line III—III in FIG. 2.

In FIG. 1 of the drawings we show an anchor davit 10 mounted on a boat 12, to guide an anchor cable or line 14 over the boat's side 16. The anchor line 14 is wound on a reel 18 to hoist an anchor 20 out of the water whenever the boat 12 is to be moved. The anchor 20 is of the mushroom type, having a shank or stem portion 22 secured to the anchor line 14 as at 23, with a massive head portion 24 formed on the shank portion 22 remote from the anchor line connection 23. Preferably the anchor 20 is made of lead with a soft vinyl plastic covering 26 to protect the boat hull.

The anchor davit 10 includes a frame or bracket 28 with a rear mounting end 30 secured to the boat 12 by suitable fastenings such as screws 32, and having a front support end 34 extending outward beyond the boat side 16. The support end 34 includes a pair of spaced side members 36, 36 having an elastomeric roller 38 supported therebetween on a shaft 40. The roller 38 is spool-shaped and includes a pair of rim portions 42, 42 with a concave tapered recess 44 formed therebetween for guiding and supporting the anchor line 14 thereon. A face 46 at each side of the roller 38 is spaced a minimum distance away from the side members 36, 36 to preclude anchor line 14 from entering the spaces between the roller side faces 46 and the side members 36.

A retaining loop or strap 48 is pivotally carried by said shaft 40, extending about the roller 38 and around the outside of side members 36, 36. The retaining loop 48 comprises a "U" shaped strap with a pair of straight side mounting legs 52, 52 retained on stub portions 50, 50 at each end of the shaft 40 by snap rings 53, 53. The legs 52, 52 are connected by a curved bight 56 which is positionable relative to the roller 38 and the anchor line 14 to prevent disengagement therebetween, as best seen in FIG. 2.

A curved tab 58 formed in the leading edge 59 of each leg 52, following a continuing curvature of the bright 56, extends inward over the rim portions 42, 42 of the roller 38 to cover the spaces between the side members 36 and the roller faces 46, 46 to further prevent wedging or fouling of the anchor line 14 and to keep the line centered on the roller 38 and riding in the tapered recess 44.

With specific reference to FIG. 3, it will be seen that the retaining loop 48 comes to rest and is supported in the anchor line retaining position by a stop 54 formed in the side member 36. A trailing edge 57 of the leg 52 supports the retaining loop 48 at a somewhat elevated angle with respect to a horizontal plane H to facilitate the entry of the anchor 20 for stowing.

Figure 4:
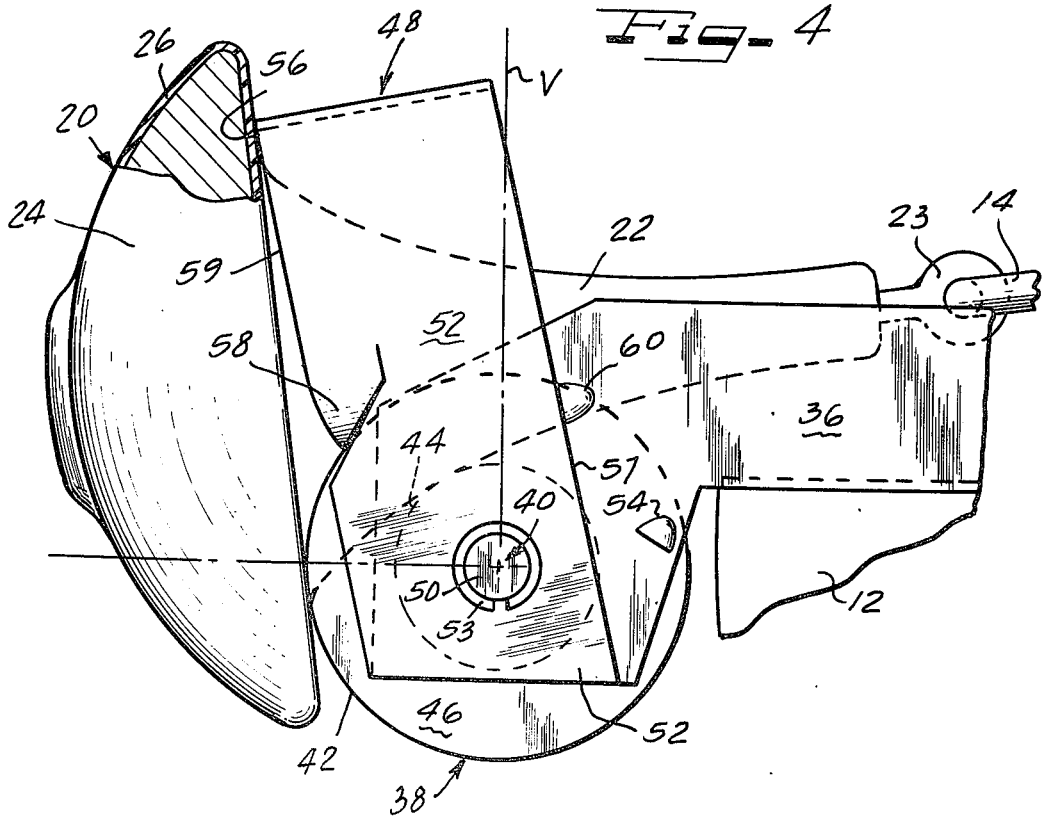
FIG. 4 is a side elevational view of the davit showing the anchor in a stowed position therein.

When the anchor 20 is raised out of the water by winding the anchor line 14 on the reel 18, as best seen in FIGS. 1 and 4, the stem portion 22 comes into contact with the roller recess 44 and is pulled up into the bright 56 of the retaining loop 48. As the reel 18 continues to wind in the anchor line 14, the anchor 20 is pivoted about the roller wherein the head portion 24 comes into contact with the leading edge 59 of the retaining loop 48 and the rim portions 42, 42 of the roller 38, causing the retaining loop 48 to pivot to an anchor stowing position as shown in FIG. 4.

The retaining loop 48 is held in this position by a second stop 60, formed in one of the side members 36 of the bracket 28, which limits further pivotal movement responsive to anchor line tension. Thus the anchor 20 is brought into a secure stowed position with its shank portion 22 extending into the bight 56 of the loop 48 and resting in the centering recess 44 of the roller 38 with the anchor's enlarged head portion 24 brought to bear firmly against the leading edge 59 of the retaining loop 48 and the rim portions 42, 42 of the elastomeric roller 38. Herein, the anchor 20 is cushioned by the elastomeric roller 38 to protect its vinyl coating 26 from damage and keep the anchor from bouncing when the boat 12 encounters rough waters. Further, davits of the present invention permit anchors with various shank sizes to be suitably stowed and protected.

While stops 60 and 54 are shown in the preferred embodiment as formed integral with the bracket 28, they may be of any sutiable construction and location to station the retaining loop 48 in related anchor stowing or anchor line retaining portions.

When the anchor line tension is released by the reel 18, the retaining loop 48 allows the anchor 20 to lower by pivoting downward, around the roller 38 and with the anchor 20, to a position where the anchor shank 22 drops free of the encircling retaining loop 48 and into the water. The stop 60 fixes the stowing position of the retaining loop 48 at a slightly downward disposed angle, with respect to a vertical plane V whereby gravity causes the loop 48 to drop to the anchor line retaining position, following the anchor's descent. Herein, the anchor 20 will never be trapped or fouled by the davit 10, thereby providing the "immediate anchor control" required for safe and dependable boat operation.

The curved tabs 58, formed in the mounting legs 52, effectively cooperate with the rim portions 42, 42 to keep the anchor line 14 centered in the tapered recess 44 of the roller 38 when larger diameter anchor lines are utilized. However, when a small diameter soft anchor line is used it is possible for the line when slack and when pulled out at a sharp angle by a sideways movement of the boat, to be forced in under one of the guide tabs 58 and to wedge under a roller end. Further, the rope may also wear against the tab edges for a few feet before slipping back into the recess 44. This wear, while slight, is still undesirable.

To eliminate these possibilities, a heavy wire, bail 66 is provided in place of the tabs 58, as a alternate form of the invention as shown in FIGS. 6 to 8, to maintain a small diameter anchor line **14*a* centered on the roller 38. The bail 66 defines a generally "U" shaped anchor line restraining guide 68. The restraining guide 68 includes a pair of spaced legs 70, 70 contoured to conform to the curvature of the roller 38 and disposed in a juxtaposed position along a substantial peripheral portion of the underside of each roller rim 42, immediately adjacent inner edges 43, 43 thereof. This peripheral portion of the roller rims includes the full range of anchor line dependency from the roller, consistent with anchor deployment under conditions of maximum boat drift as best seen in FIG. 7 of the drawings. The contoured legs 70, 70 of the restraining guide 68 are joined at one end by a transverse leg 72 which extends across the tapered recess 44, well behind a point of possible contact with the anchor line 14*a*, as best seen in FIG. 7**.

Each contoured leg includes a short angled portion 74 which terminates in an out-turned stub extension 75 providing a means of mounting the bail 66 to the retaining loop 48 for pivotal movement therewith. Each stub extension 75 is carried in a complimentary aperture 76 formed near the leading edge 59 of each of the legs 52 of the retaining loop 48 and may be secured therein by welding or suitable fastening devices or may be adequately retained in the apertures 76, 76 by inherent spring tension in the bail 66. Herein, bights 78, 78 formed at the junctures of the angled portions 74, 74 and the stub extensions 75, 75, are pressed into contact with the retaining loop legs 52 to obtain a hold thereon to accommodate pivotal movement of the contoured legs 70, 70 about the roller 38, coincidential with the retaining loop 48. Thus the bail 66 is pivoted from a non-obstructive position relative to the anchor 20 as seen in FIG. 8 to an operative position to prevent anchor line fouling, with the movement of the retaining loop 48 from its second, anchor stowing position to its first anchor line retaining position.

With specific reference to FIG. 6 of the drawings in which the anchor 20 has been dropped and the boat subjected to considerable side drift, the anchor line 14*a* is restrained and guided over the rounded edges of the contoured legs 70, 70 to prevent excessive transverse deflection which may otherwise allow the anchor line to become wedged between side members 36 and the roller faces 46 when the anchor is raised.

When hoisting the anchor 20 and stowing it as shown in FIG. 8, the contoured legs 70, 70 of the restraining guide 68 are interposed between the anchor head portion 24 and the roller rim portions 42 and serve as the lower stop or abutment when the hoisting or lifting force is applied to the anchor line 14*a* by the reel 18 to secure the anchor 20 in its stowed position. The pivotal movement of the retaining loop 48 to its second position accommodates the placement of the anchor 20 in a gravitationally responsive inclination from which position the anchor freely drops clear of the anchor davit 10, back into the water upon releasing the hoisting force tension on the anchor line.

Thus the anchor is remotely controlled by the reeling force to wind in the anchor line 14 and stow the anchor in a secure position and to instantaneously drop the anchor from the stowed position by simply releasing the tension or lifting force on the anchor line. Accordingly, a positive responsive control is provided to raise, stow and drop the anchor from a safe convenient location in the boat without the need to move about the boat to manually lower the anchor.

It will be seen from the foregoing that we have provided a greatly improved anchor davit which will stow an anchor in a safe, secure, visible position and which cushions the anchor to protect against damage and prevents unpleasant anchor bouncing in rough water. Further, the anchor line is retained on the davit roller, free from wedging or fouling under the roller.

It should be understood that we wish to embody within the scope of the patent warranted hereon all such modifications as may reasonably occur to a person skilled in the art.

We claim:

1. A davit for handling an anchor and anchor line over the side of a boat comprising:

a bracket having a mounting end and a support end;

a roller, rotatably mounted on a shaft at the support end of said bracket;

a retaining loop mounted for pivotal movement about said roller, between a first, anchor line retaining position and a second, anchor stowing position;

a first stop associated with said bracket and arranged to support said retaining loop in said second position;

a second stop associated with said bracket and arranged to locate said retaining loop in said second position;

said retaining loop being mounted on said shaft for pivotal movement coaxial with said roller;

said shaft supporting said roller between a pair of spaced side members of said bracket in minimal spaced relationship therefrom, and a pair of tabs provided on said retaining loop extending inward to overlap the spaces between the roller and said side members and to overlap an edge portion at each side of said roller;

said roller comprising an elastomeric roll with a pair of rim portions and having a tapered recess formed therebetween for guiding and supporting an anchor line and for centering and supporting an anchor thereon;

said anchor being brought into a stowing position by the pivotal movement of said retaining loop from said first position to said second position by raising said anchor, said loop forming a first anchor stop securing means and said roller rim portions forming a second anchor stop cushioning means, said retaining loop when in the second position being gravitationally responsive to accommodate returning the retaining loop to the first position upon lowering said anchor;

the pivotal movement of said retaining loop between said first position and said second position being less than 90° to provide said gravitational response.

2. A davit for guiding the anchor line and supporting a boat anchor secured to said line which comprises a bracket having a rear end adapted to be secured to a boat and a front end adapted to extend outwardly beyond the side of the boat and including a pair of spaced sides, a shaft spanning the space between said spaced sides and mounted at its ends in said sides, a roller between said sides mounted on said shaft, a U-shaped strap having side legs overlapping said sides and a bight portion spaced outwardly from said roller, means swingably mounting said side legs of the strap on said sides of the bracket, a first stop limiting the downward swinging movement of the strap to hold the bight portion of the strap in front of the front end of the bracket, a second stop limiting the upward swinging movement of the strap to a downwardly disposed angle with respect to a vertical plane through the axis of the shaft whereby said strap will drop by gravity from the second stop to the first stop, said davit adapted to receive an anchor line over the bracket, through the strap, and around the roller to an anchor, said strap guiding said line over the roller and swingable from its first stop position to its second stop position by the anchor when the anchor line pulls the anchor to a stowing position on the roller and said second stop holding the strap to maintain the anchor in a gravitationally responsive stowed position so that when the anchor line is released the anchor will drop by gravity with the strap following the anchor to the first stop position for guiding the anchor line.

3. The davit of claim 2 wherein the rear end of the bracket is an elongated channel strip and the side legs of the strap straddle the sides of the front end of the bracket.

4. The davit of claim 2 wherein the roller is spool-shaped with rims closely adjacent to the sides of the front end of the bracket and a guide portion between the rims tapers to a small diameter center portion for centering the anchoring line.

5. The davit of claim 2 wherein the side legs of the strap are pivotally mounted on the ends of the shaft.

6. The davit of claim 2 wherein a U-shaped bail wire curved to overlie the ends of the roller has ends mounted in the side legs of the strap and is effective to prevent the anchor line from wedging between the roller and sides of the front end of the bracket.

7. The davit of claim 2 wherein the shaft supports the roller between said sides of said bracket in minimal spaced relationship therefrom, and a pair of tabs on the legs of said strap extend inwardly to overlap the spaces between the roller and said sides and to overlap an edge portion at each side of said roller to prevent the anchor line from wedging between the roller and sides of the bracket.

8. The davit of claim 2 wherein the swinging movement of said strap between said first and second stops is less than 90 degrees to provide said gravitational response.

9. The davit of claim 2 for guiding the anchor line and supporting a boat anchor of the type having a head and a central stem projecting therefrom attached at its end to the anchor line wherein the stem rides on the roller as the anchor line pulls the stem through the strap and the head engages the bight portion of the strap to swing the strap against the second stop when the anchor line pulls the anchor to its stowed position and the strap cooperates with the roller to fixedly hold the anchor in stowed position on the davit.

10. The davit of claim 2, including an anchor line retainer guide mounted on said strap and having a pair of guide legs extending about a substantial peripheral portion of the roller of each side thereof to overlie the roller in an anchor line restraining posture to keep it centered on the roller.

* * * * *